US006210110B1

(12) United States Patent
Neisen

(10) Patent No.: US 6,210,110 B1
(45) Date of Patent: Apr. 3, 2001

(54) PROPELLER HAVING A STRESS RELIEF FLARE ARRANGEMENT

(75) Inventor: Gerald F. Neisen, Rockport, TX (US)

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 09/327,890

(22) Filed: Jun. 8, 1999

(51) Int. Cl.[7] ..... B36H 21/32
(52) U.S. Cl. ..... 416/93 A; 416/234; 416/244 B
(58) Field of Search ..... 416/62, 93 A, 416/193 R, 223 R, 234, 244 B, 245 A; 440/49; 29/889.6; 264/328.1

(56) References Cited

U.S. PATENT DOCUMENTS 5,114,313 * 5/1992 Vorus ..... 416/93 A
5,158,433 * 10/1992 Cleary ..... 416/93 A
5,527,195 * 6/1996 Neisen ..... 416/93 A

* cited by examiner

*Primary Examiner*—Edward K. Look
*Assistant Examiner*—Liam McDowell
(74) *Attorney, Agent, or Firm*—Armstrong Teasdale LLP

(57) ABSTRACT

A propeller including, in one embodiment, a flare having a sinusoidal, or tulip, shape is described. The flare is located at a trailing edge of the propeller, and the sinusoidal flare shape of the propeller trailing edge has reduced stresses as compared to stresses associated with known flare rings. Specifically, stress is reduced in the sinusoidal flare shape due to smooth trailing surfaces and the uneven edge of the flare. As a result, and during fabrication, potential for cracking the trailing edge of the flair is reduced. In addition, the flare has greater strength as compared to at least some known flare rings in that stresses are more evenly distributed along the tulip shaped trailing edge.

26 Claims, 3 Drawing Sheets

PROPELLER HAVING A STRESS RELIEF FLARE ARRANGEMENT

BACKGROUND OF THE INVENTION

The invention relates generally to outboard and stern drive engines, and more particularly, to apparatus for preventing gases (e.g., exhaust, air) from flowing into a propeller blade.

Through-propeller exhaust type engines include an exhaust casing extending from a power head, and a lower unit secured to the exhaust casing. The lower unit includes a gear case which supports a propeller shaft, and a propeller is engaged to the shaft. The propeller includes an outer hub through which exhaust gases are discharged.

During operation, a region of low pressure is developed rearwardly of the propeller. A thin low pressure boundary layer around the hub can also develop. The low pressure condition rearwardly of the hub has a tendency to join with the low pressure boundary layer, and exhaust gas migrates forwardly along the propeller hub between the blades and along the rear, or low pressure, face of the propeller blades, thereby causing conditions of "cavitation" or "ventilation". Such conditions prevent the propeller blade from biting into the water and result in an efficiency loss. In addition, excessively low pressure in the region rearwardly of the propeller hub results in a drag on the forward movement of the engine through the water.

Known propeller structures for preventing ventilation include diverging flare rings and converging rings at the rear end of the propeller hub. The rings affect the flow of water over the hub and prevent migration of the exhaust gases along the hub. For example, with an aluminum propeller, and after die cast operations, the ring is formed by welding, swaging, or attaching a full-circle ring to the hub.

With such rings, and even during minor underwater impacts, the rings can be damaged and even lost. That is, the rings can be separated from the propeller hub and then sink to the bottom of the river, lake, or ocean. Damage and loss of such rings can result in customer dissatisfaction.

In addition, and with some ring configurations, slots are formed in the ring during fabrication. Formation of the slots in the ring results in high stress areas adjacent the slots, i.e., at the edges of the slots. Such high stress areas, i.e., the edges, are susceptible to cracking and breaking off. Such cracked or broken off edges are not aesthetically acceptable and can result in customer complaints.

BRIEF SUMMARY OF THE INVENTION

The present invention, in one aspect, is a propeller including a flare having a sinusoidal, or tulip, shape at a trailing edge of the propeller. The sinusoidal flare shape of the propeller trailing edge has less stress concentration than the stress concentration associated with at least some known flare rings. Specifically, stress is reduced in the sinusoidal flare shape due to smooth trailing surface and the uneven edge of the flare. As a result, potential for cracking the trailing edge of the flair is reduced. In addition, the flare has greater strength as compared to at least some known flare rings in that stresses are more evenly distributed along the tulip shaped trailing edge. The reduced stress concentration also enables expanding the flare more than is possible with some known flare rings.

DETAILED DESCRIPTION OF THE INVENTION

The present invention is not limited to practice in connection with a particular engine, nor is the present invention limited to practice with a particular propeller configuration. The present invention can be utilized in connection with many engine and propeller configurations. Therefore, although the invention is described below in the context of an exemplary outboard engine and propeller configuration, the invention is not limited to practice with such engine and propeller. For example, the invention can be used in connection with both outboard engines and stern drive type engines having through-propeller exhaust arrangements. Also, the present invention can be used in connection with engines having through-propeller air (or any other gas) arrangements.

Figure 1:
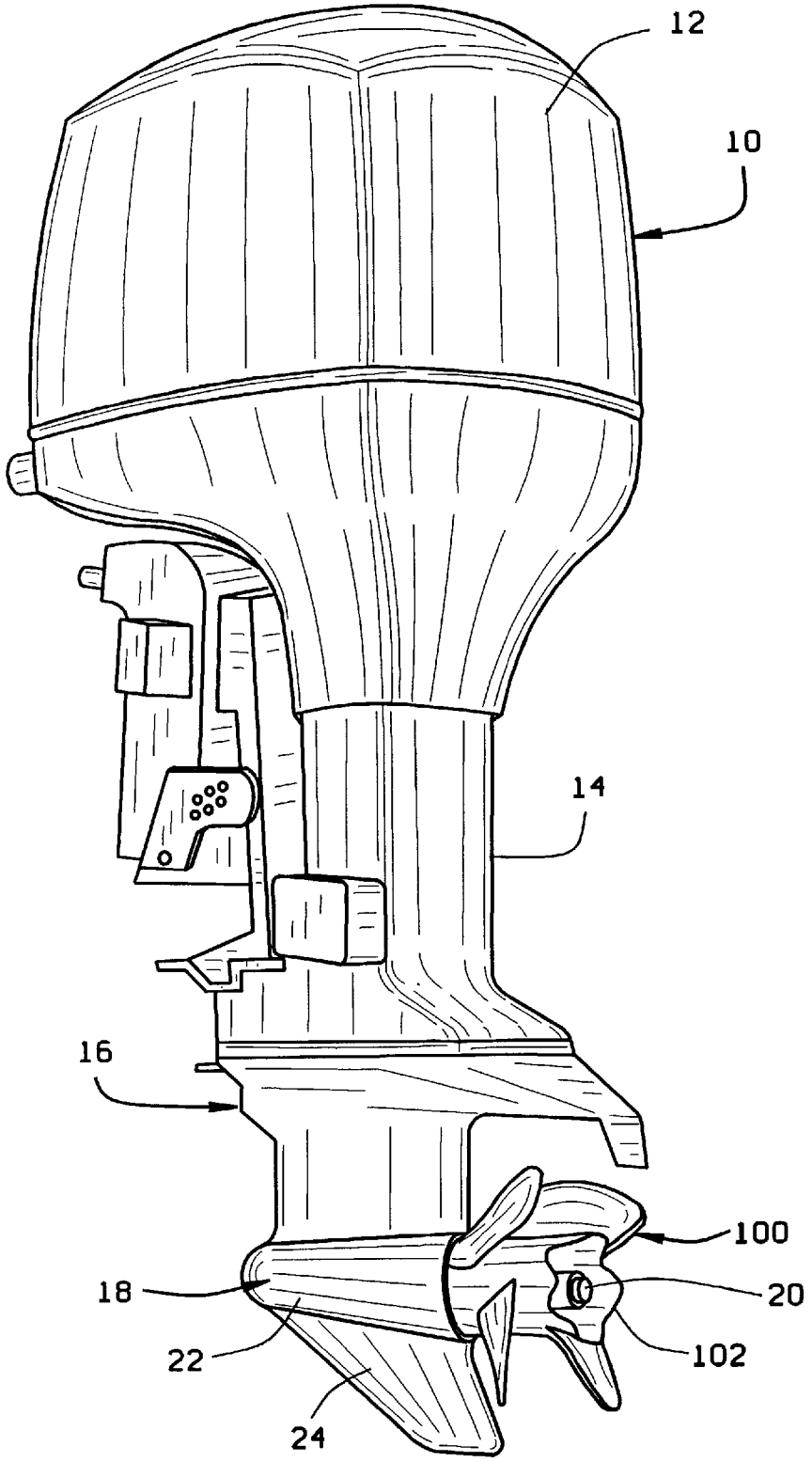
FIG. 1 is a perspective view of an outboard engine.

Referring now particularly to the drawings, FIG. 1 is a perspective view of an exemplary outboard engine 10, such as an outboard engine commercially available from Outboard Marine Corporation, Waukegan, Ill. Engine 10 includes a cover 12 which houses a power head (not shown), an exhaust housing 14, and a lower unit 16. Lower unit 16 includes a gear case 18 which supports a propeller shaft 20. Gear case 18 includes a bullet, or torpedo, 22 and a skeg 24 which depends vertically downwardly from torpedo 22.

Figure 2:
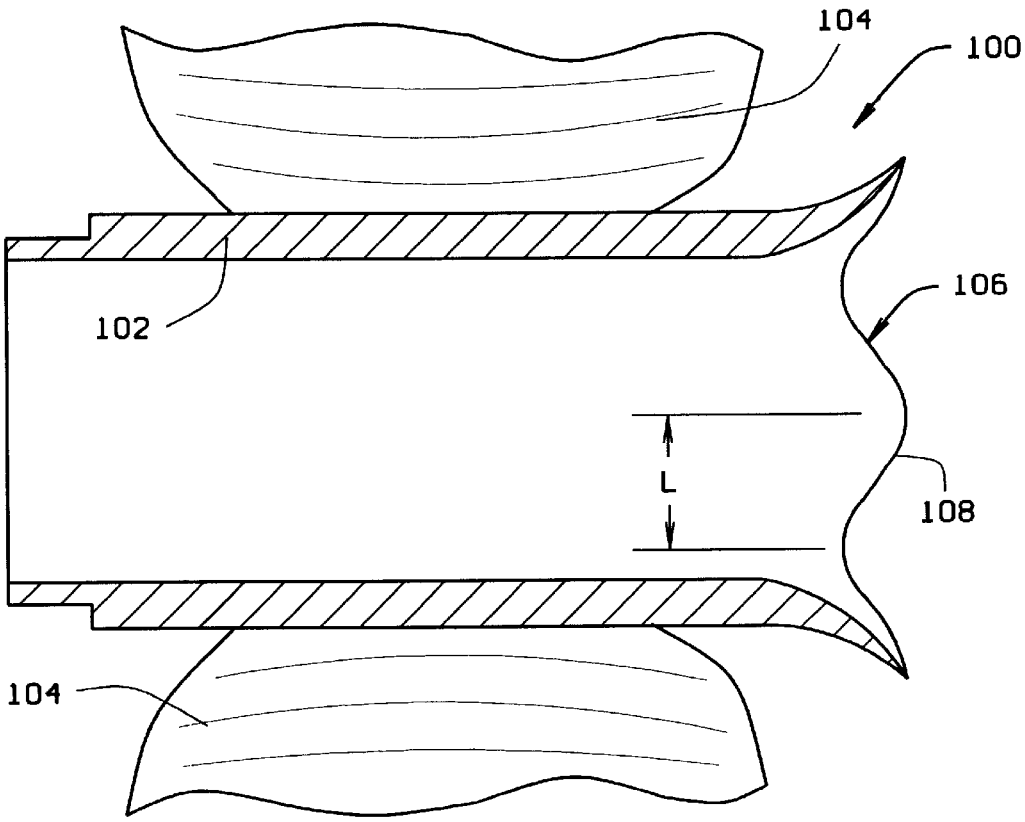
FIG. 2 is a side, partial cross sectional view of a portion of a propeller constructed in accordance with one embodiment of the present invention.
Figure 3:
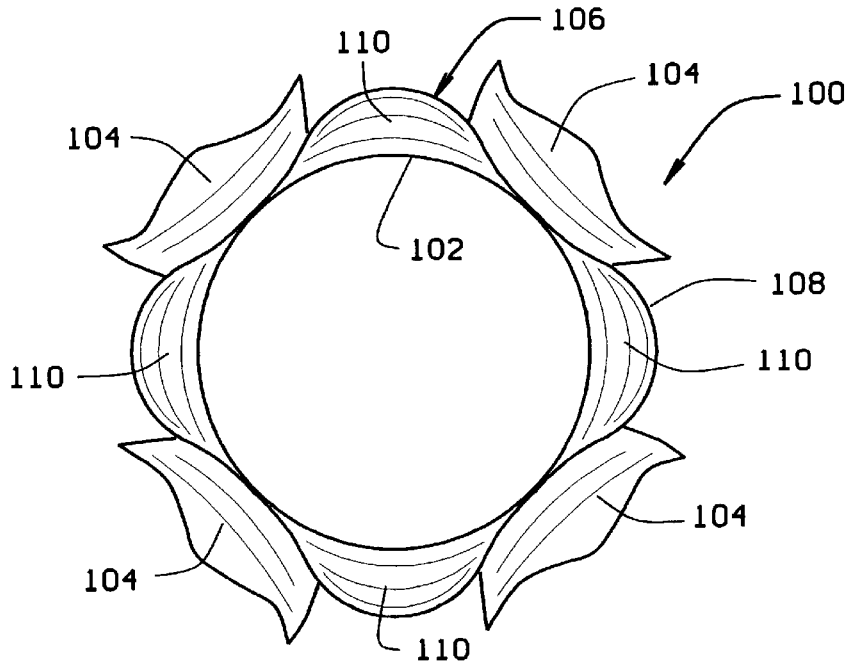
FIG. 3 is a back view, i.e., the trailing edge, of a portion of the propeller shown in FIG. 2.

A propeller 100, constructed in accordance with one embodiment of the present invention, is secured to shaft 20. FIG. 2 is a perspective view of a portion of a propeller 100, and FIG. 3 is a trailing end view of propeller 100. Propeller 100 includes a central hub 102 and a plurality of blades 104 (e.g., three of four blades). Propeller 100 further includes a flare 106 having a trailing edge 108 which is a continuous surface having a sinusoidal, or tulip, shape.

As shown in FIG. 3, flare 106 includes flare portions 110 which extend, or flare out, from hub 102. Flare portions 110 affect the flow of water over hub 102 and prevent migration of exhaust gases along hub 102. The number of flare portions 110 is typically selected to correspond to the number of blades 104. As shown in FIG. 3, and for a four blade propeller, a center line of each flare portion 110 is about 45° out of phase with respect to a center line of adjacent blades 104. For a three blade propeller, a center line of each flare is about 60° out of phase with respect to a center line of adjacent blades. However, fewer or more flares than the number of blades could also be utilized.

A length L, or the extent to which each flare portion 110 extends from center hub 102 is selected depending upon the particular engine in which propeller is to be used and the desired operating characteristics of propeller 100. An advantage of the tulip, or sinusoidal, shaped flare 106 is that such length can be selected from within a broad range of lengths because stress concentrations are not formed in flare 106. An exemplary range of length L is 0.25 to 2.50 inches.

Propeller 100 is fabricated using known aluminum die cast operations. During fabrication, and as blade edge 108 is trimmed, edge 108 is flared with a swagging cone tool to form the sinusoidal, or tulip, shape. During the fabrication process, the smooth surface of trailing edge 108 prevents formation of high stress areas. In addition, the stresses on propeller trailing edge 108 are evenly distributed along edge 108. Therefore, in addition to an even distribution of stresses, the peak stresses are lower than the peak stresses, i.e., the high stress concentration areas, in some known flare ring configurations.

Figure 4:
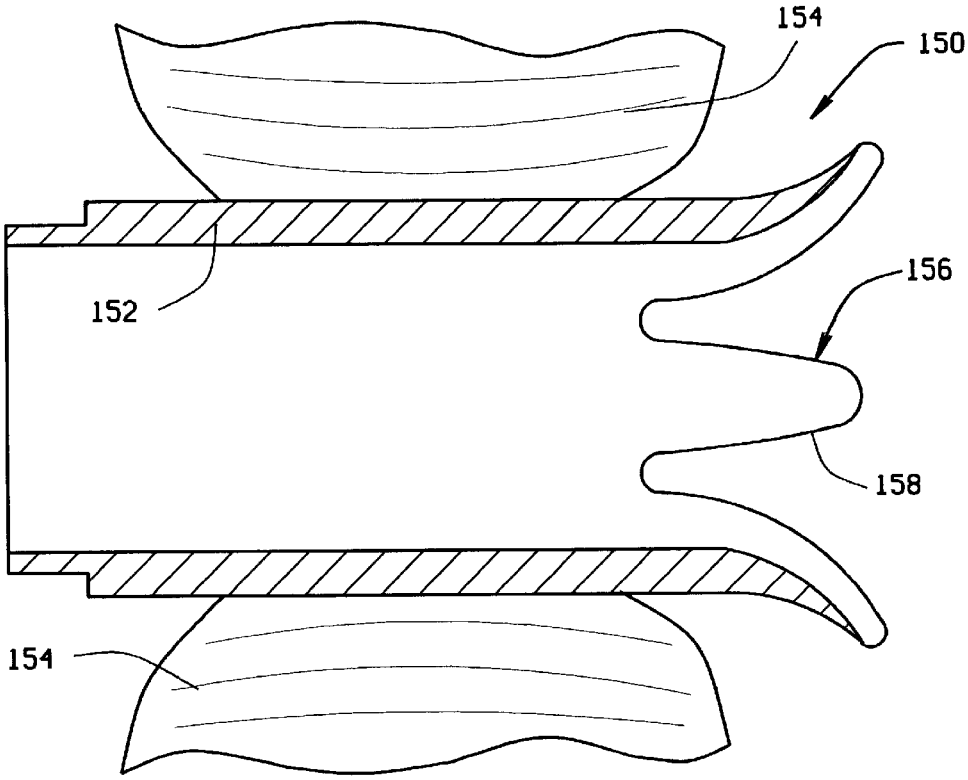
FIG. 4 is a side, partial cross sectional view of a portion of a propeller constructed in accordance with an alternative embodiment of the present invention.
Figure 5:
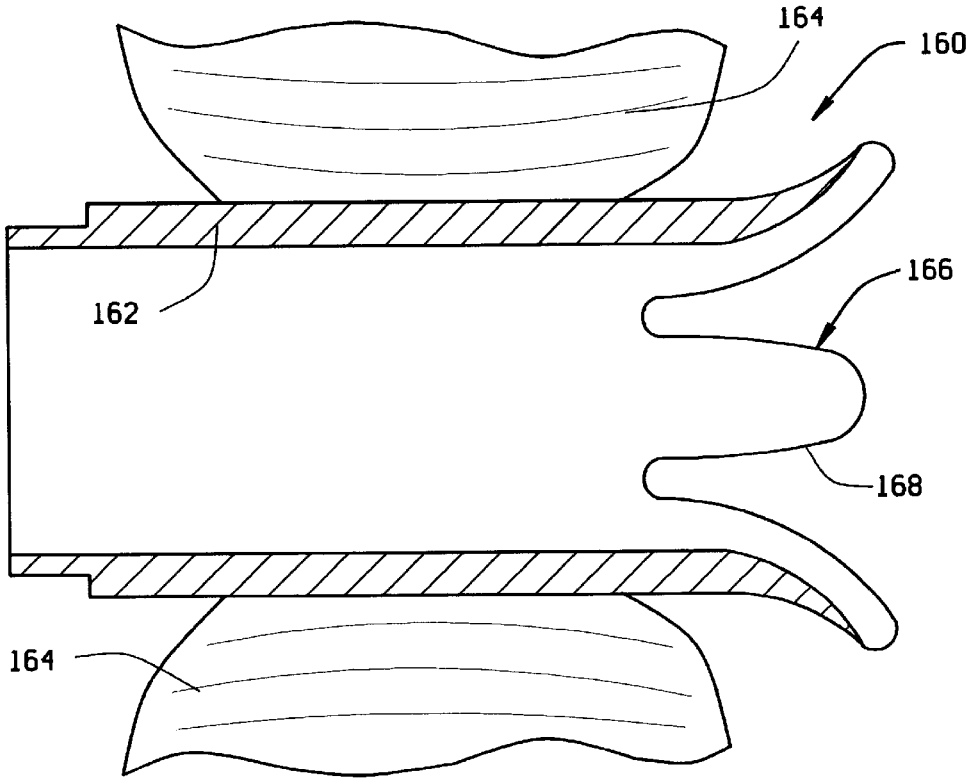
FIG. 5 is a side, partial cross sectional view of a portion of a propeller constructed in accordance with yet another alternative embodiment of the present invention.

Flare 106 is illustrated as having a sinusoidal shape. In accordance with other embodiments of the invention, the flare has other shapes. For example, FIG. 4 illustrates a propeller 150 including a hub 152, blades 154 and a flare 156 having a trailing edge surface 158 with a parabolic shape. Alternatively, FIG. 5 illustrates a propeller 160 including a hub 162, blades 164 and a flare 166 having a trailing edge surface 168 with an elliptical shape. Generally, and in accordance with the present invention, the trailing edge surface of the flare is curved and continuous to avoid formation of high stress concentration areas yet also is effective for preventing migration of exhaust gases along the propeller hub.

Rather than being integral with hub 102, flare 106 can be separately formed as a ring and then welded to hub 102, as is known in the art. Forming flare 106 integral with hub 102 provides the advantage that flare 106 generally cannot be separated from hub during operation, which avoids customer complaints. However, even if flare 106 is formed separate from hub 102, such flare 106 provides the advantage of less stress concentration than at least some known flare rings.

In addition, propeller 100 can be fabricated from material other than aluminum. For example, material such as bronze, or any other material that can be used in a die cast operation, can be used to fabricate propeller 100. Further, material that can be used in injection molding processes, such as plastic, can be used to fabricate propeller 100.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A propeller comprising:

a hub configured to be secured to a motor shaft;

a plurality of blades extending from said hub; and a sinusoidal shaped flare at a trailing end of said hub.

2. A propeller in accordance with claim 1 wherein said sinusoidal shaped flare comprises a continuous end surface.

3. A propeller in accordance with claim 1 wherein said propeller is fabricated using at least one of a die cast operation and an injection molding process.

4. A propeller in accordance with claim 1 wherein said flare is integral with said hub.

5. A propeller in accordance with claim 1 wherein said flare is welded to said hub.

6. A propeller comprising:

a center hub comprising a fore end and an aft end;

a plurality of blades extending from said center hub; and a flare extending from said center hub aft end, said flare having a curved and continuous trailing edge surface.

7. A propeller in accordance with claim 6 wherein said trailing edge surface has at least one of a sinusoidal shape, a parabolic shape, and an elliptical shape.

8. A propeller in accordance with claim 6 wherein said propeller is fabricated using at least one of a die cast operation and an injection molding process.

9. A propeller in accordance with claim 6 wherein said flare is welded to said hub.

10. A propeller comprising:

a center hub comprising a fore end and an aft end;

a plurality of blades extending from said center hub; and a flare extending from said center hub aft end, fabrication stresses in said flare being substantially evenly distributed with respect to a flare trailing edge, said flare having at least one of a sinusoidal shape, a parabolic shape, and an elliptical shape.

11. A propeller in accordance with claim 10 wherein said flare trailing edge comprises a continuous end surface.

12. A propeller in accordance with claim 10 wherein said propeller is fabricated using at least one of a die cast operation and an injection molding process.

13. A propeller in accordance with claim 10 wherein said flare is welded to said hub.

14. A propeller comprising:

a center hub comprising a fore end and an aft end;

a plurality of blades extending from said center hub; and a flare extending from said center hub aft end, fabrication stresses in said flare being substantially evenly distributed with respect to a flare trailing edge, said flare having continuously varying diameters across said flare trailing edge.

15. A propeller in accordance with claim 14 wherein said flare has at least one of a sinusoidal shape, a parabolic shape, and an elliptical shape.

16. A propeller in accordance with claim 14 wherein said flare trailing edge comprises a continuous end surface.

17. A propeller in accordance with claim 14 wherein said propeller is fabricated using at least one of a die cast operation and an injection molding process.

18. A propeller in accordance with claim 14 wherein said flare is welded to said hub.

19. A propeller kit comprising a flare for being secured to an aft end of a propeller hub, said flare having a curved and continuous trailing edge surface.

20. A propeller kit in accordance with claim 19 wherein a trailing edge of said flare has at least one of a sinusoidal shape, a parabolic shape, and an elliptical shape.

21. A propeller kit in accordance with claim 19 wherein said flare is fabricated using at least one of a die cast operation and an injection molding process.

22. A method for fabricating a propeller, said method comprising the steps of:

forming an integral hub and blade propeller; and machining an end of a hub formed in a die cast operation so that the end has a curved and continuous surface.

23. A method in accordance with claim 22 wherein said surface is formed using a swagging cone tool.

24. A method in accordance with claim 22 wherein said surface is formed in conjunction with trimming a blade edge.

25. A method in accordance with claim 22 wherein said surface has at least one of a sinusoidal shape, a parabolic shape, and an elliptical shape.

26. A method for fabricating a propeller comprising the step of injection molding an integral hub and blade propeller so that an end of the hub has a curved and continuous surface.

* * * * *